US012768090B2

(12) United States Patent
Jo et al.

(10) Patent No.: US 12,768,090 B2
(45) Date of Patent: Oct. 20, 2026

(54) SYSTEM AND METHOD FOR APPLIANCE DIAGNOSTICS

(71) Applicant: Haier US Appliance Solutions, Inc., Wilmington, DE (US)

(72) Inventors: Jaewon Jo, Seongnam (KR); Seonghoon Ryu, Suwon (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 179 days.

(21) Appl. No.: 18/505,401

(22) Filed: Nov. 9, 2023

(65) Prior Publication Data

US 2025/0154704 A1 May 15, 2025

(51) Int. Cl.

| | |
|---|---|
| ***D06F 33/47*** | (2020.01) |
| ***D06F 34/05*** | (2020.01) |
| ***D06F 34/18*** | (2020.01) |
| ***D06F 58/50*** | (2020.01) |
| *D06F 103/04* | (2020.01) |
| *D06F 103/06* | (2020.01) |
| *D06F 105/58* | (2020.01) |

(52) U.S. Cl.

CPC ..... *D06F 34/05* (2020.02); *D06F 33/47* (2020.02); *D06F 34/18* (2020.02); *D06F 58/50* (2020.02); *D06F 2103/04* (2020.02); *D06F 2103/06* (2020.02); *D06F 2105/58* (2020.02)

(58) Field of Classification Search

None

See application file for complete search history.

(56) References Cited

U.S. PATENT DOCUMENTS

| | | | | |
|---|---|---|---|---|
| 7,373,737 | B2 | 5/2008 | Lyu et al. | |
| 7,735,239 | B2 | 6/2010 | Jeong et al. | |
| 11,025,447 | B2 | 6/2021 | Ebrom et al. | |
| 11,242,632 | B1 * | 2/2022 | Zeru | D06F 39/12 |
| 11,680,348 | B1 * | 6/2023 | Grandt | D06F 29/005 68/20 |
| 2021/0301447 | A1 * | 9/2021 | Choe | D06F 34/18 |
| 2022/0145524 | A1 | 5/2022 | Salameh et al. | |

OTHER PUBLICATIONS

DE 19946245 A1 machine translation, Controlling Washing Program Involves Use Of Additional Laundry Weight Measurement, Hein (Year: 2000).*

* cited by examiner

*Primary Examiner* — Cristi J Tate-Sims

(74) *Attorney, Agent, or Firm* — Dority & Manning, P.A.

(57) ABSTRACT

A dryer appliance, an interconnected system of appliances, and a method for appliance diagnostics is provided. The method includes determining a washer load parameter; transmitting, from the washer appliance to the dryer appliance, the washer load parameter; determining a dryer load parameter; comparing a difference between the washer load parameter to the dryer load parameter to a difference threshold; incrementing a count when the difference between the washer load parameter to the dryer load parameter exceeds the difference threshold; and generating a fault signal if the count exceeds a count threshold.

20 Claims, 3 Drawing Sheets

SYSTEM AND METHOD FOR APPLIANCE DIAGNOSTICS

FIELD

The present subject matter relates generally to appliances and methods for wireless communication and fault determination.

BACKGROUND

Appliances, such as residential and commercial laundry appliances, may include sensors for determining laundry load size. Load size detection from such sensors may be utilized for selecting cycles and operating the washer or dryer appliance. However, if the sensor fails or experiences miscalibration or drift, incorrect or inaccurate sensor values may go undetected. Additionally, incorrect or inaccurate sensor values may be utilized in cycle selection, adjustment, and appliance operation, which may result in deteriorated performance.

Accordingly, systems and methods for determining an operational state of an appliance is desired and would be advantageous. Additionally, or alternatively, systems and methods for appliance that address one or more of the above issues is desired and would be advantageous.

BRIEF DESCRIPTION

Aspects and advantages of the invention will be set forth in part in the following description, or may be obvious from the description, or may be learned through practice of the invention.

An aspect of the present disclosure is directed to a system for appliance communication. The system includes a washer appliance including one or more washer appliance sensors configured to determine a washer load parameter, the washer appliance including a first controller including a first communications device; a dryer appliance including one or more dryer appliance sensors configured to determine a dryer load parameter, the dryer appliance including a second controller including a second communications device configured to communicatively couple to the first communications device to form an interconnected pair of washer and dryer appliances; wherein one or both of the first and second controllers is configured to execute instructions that cause the washer appliance and the dryer appliance to perform operations, the operations including transmitting, via the first communications device to the second communications device, the washer load parameter; determining, via the one or more dryer appliance sensors, the dryer load parameter; comparing a difference between the washer load parameter to the dryer load parameter to a difference threshold; incrementing a count when the difference between the washer load parameter to the dryer load parameter exceeds the difference threshold; and generating a fault signal if the count exceeds a count threshold.

An aspect of the present disclosure is directed to a dryer appliance including one or more sensors configured to determine a dryer load parameter; a controller including a short-range communications device configured to communicatively couple to a washer appliance, the controller configured to execute instructions that cause the dryer appliance to perform operations, the operations including communicatively coupling, via the short-range communications device, to the washer appliance; obtaining, from the washer appliance, a washer load parameter determining, via the one or more sensors, the dryer load parameter based at least in part on the washer load parameter; comparing a difference between the washer load parameter to the dryer load parameter to a difference threshold; incrementing a count when the difference between the washer load parameter to the dryer load parameter exceeds the difference threshold; and generating a fault signal if the count exceeds a count threshold.

An aspect of the present disclosure is directed to a computer-implemented method for determining an operational state at a laundry appliance, the method including determining, via one or more sensors at a washer appliance, a washer load parameter, the washer load parameter including one or more of a washer load type, a first dry load size, a first wet load size, or combinations thereof; transmitting, from the washer appliance to the dryer appliance, the washer load parameter; determining, via one or more sensors at a dryer appliance, a dryer load parameter, the dryer load parameter including one or more of a dryer load type, a second wet load size, a second dry load size, or combinations thereof; comparing a difference between the washer load parameter to the dryer load parameter to a difference threshold; incrementing a count when the difference between the washer load parameter to the dryer load parameter exceeds the difference threshold; and generating a fault signal if the count exceeds a count threshold.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
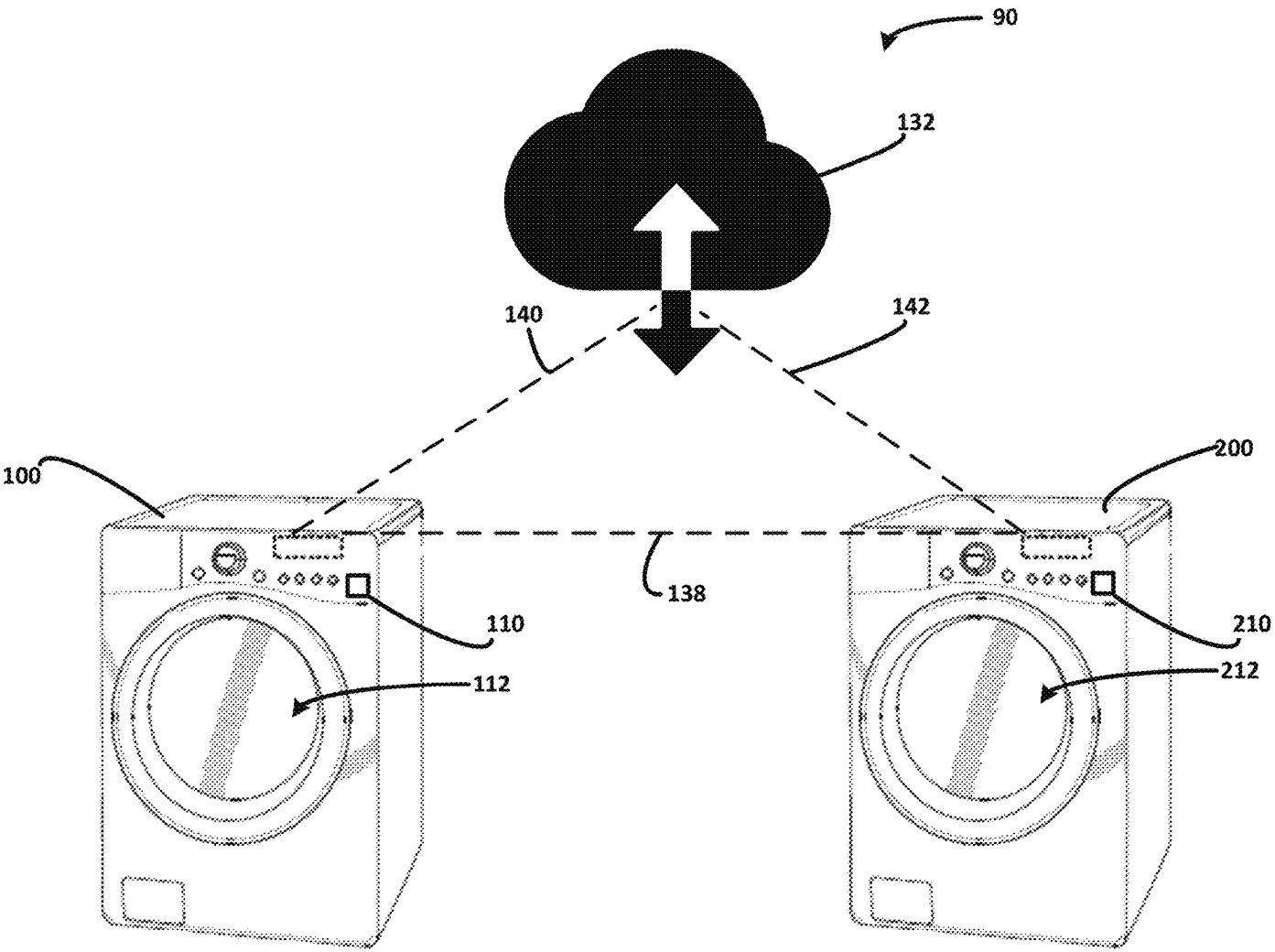
FIG. 1 provides a schematic embodiment of an interconnected system of appliances in accordance with aspects of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components or systems. For example, the approximating language may refer to being within a 10 percent margin (i.e., including values within ten percent greater or less than the stated value). In this regard, for example, when used in the context of an angle or direction, such terms include within ten degrees greater or less than the stated angle or direction (e.g., "generally vertical" includes forming an angle of up to ten degrees in any direction, such as, clockwise or counterclockwise, with the vertical direction V).

Referring now to the drawings, FIG. 1 depicts a schematic exemplary embodiment of an interconnected system of appliances (hereinafter, "system 90"). Embodiments of the system 90 form a system for appliance communication and a system for determining an operational state of an appliance. Embodiments of the system 90 may be configured to perform operations or steps of a method for determining an operational state of an internet communications device at one or more appliances (hereinafter, "method 1000"). Embodiments of system 90 may additionally, or alternatively, be configured to perform operations or steps of a method for diagnostics at a dryer appliance, or at an interconnected pair of appliances.

Figure 2:
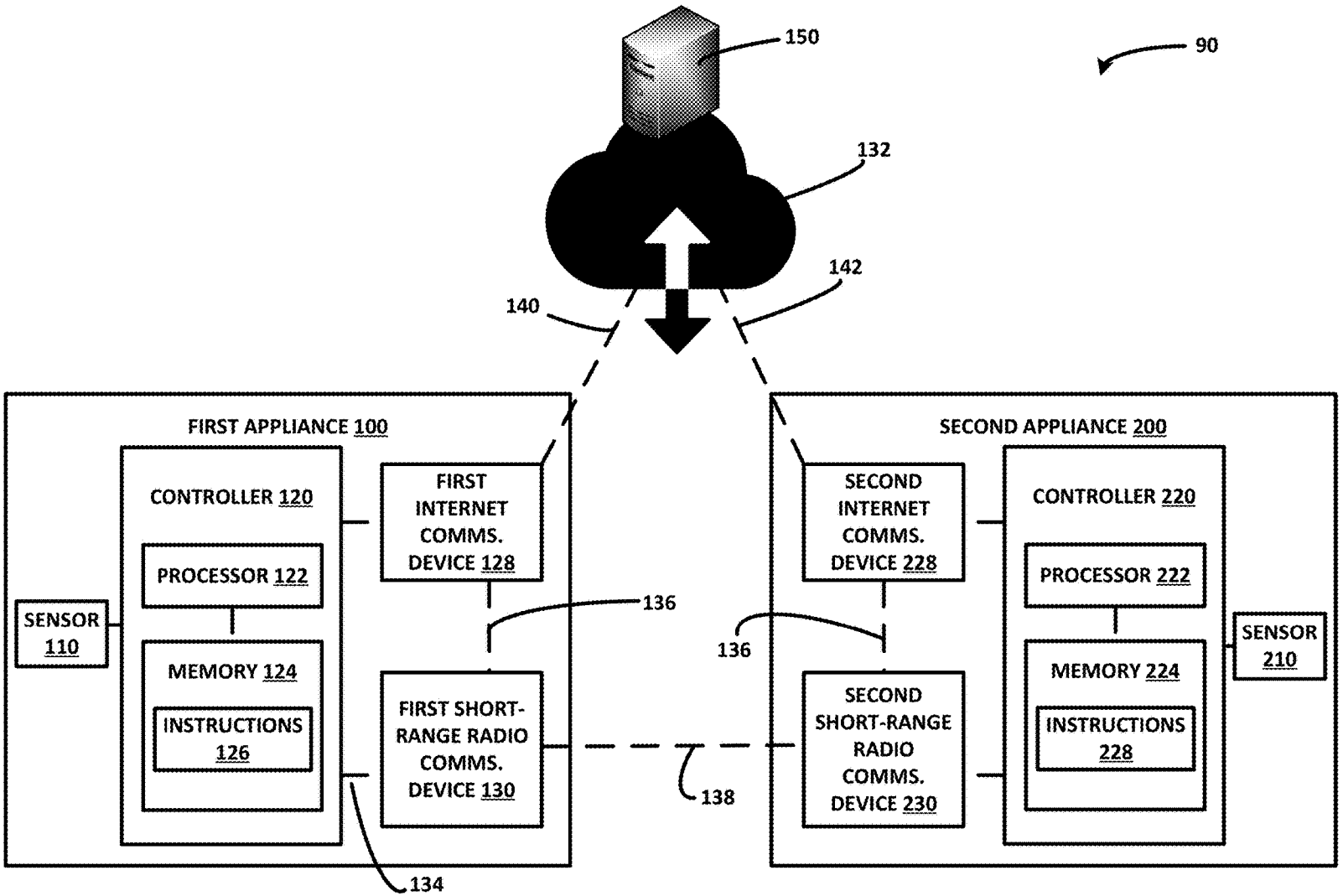
FIG. 2 provides a schematic embodiment of an interconnected system of appliances in accordance with aspects of the present disclosure.

Embodiments of the system 90 includes two or more appliances 100, 200 positioned within communicative range of one another relative to a short range radio communications device, such as depicted in FIG. 2 at short range radio communications devices 130, 230 at respective appliances 100, 200. The short range radio communications devices 130, 230 are configured to allow direct wireless communication between one another. Devices 130, 230 are configured to use a radio frequency to share data over a short distance (e.g., up to approximately 3 meters, or up to approximately 30 meters). Embodiments of the system 90 are configured to communicatively couple together the devices 130, 230 at respective appliances 100, 200. Embodiments of the devices 130, 230 may be configured in accordance with Bluetooth® wireless communications standards, such as Bluetooth® Low Energy (BLE), or other appropriate short range, low-power, wireless protocols, such as, but not limited to, Unison, Xender, Xigbee®, and the like.

Devices 130, 230 may be configured for direct wireless communication in contrast to internet communications devices 128, 228 at respective appliances 100, 200 configured to communicatively couple to a remote or cloud-based server 150 or computing network 132. Network 132 may include one or more of a local area network (LAN), a wide area network (WAN), a personal area network (PAN), the Internet, a cellular network, or any other suitable wireless network. Internet communications devices 128, 228 are configured to transmit and receive signals, data packets, information, datasets, and the like, over the network 132 and between the appliance 100, 200 and the server 150. The server 150 may be configured to store and transmit data in a database, or providing computational processing, relating to controls, control signals, software patches or updates, or other Over-the-Air (OTA) processes as may be appropriate for appliances 100, 200. In addition, such communication may use a variety of communication protocols (e.g., TCP/IP, HTTP, SMTP, FTP), encodings or formats (e.g., HTML, XML), and/or protection schemes (e.g., VPN, secure HTTP, SSL).

It should be appreciated that devices 130, 230 may form radio communications devices configured to allow for direct communication or pairing of one another (e.g., depicted schematically via line 138 in FIG. 2), such as may contrast with devices 128, 228 forming relatively long-range radio communications devices as may be configured to communicate through a wired or wireless network 132 (e.g., Internet, Intranet, LAN, WAN, PAN, etc.). Accordingly, communicative coupling via devices 130, 230 may allow for receipt and transmission of data and signals, such as described herein, without requiring operation or communication through devices 128, 228 or computing network 132. When applied to various steps of method 1000, advantages and benefits may be provided, such as local transmission, receipt, or adjustment of signals, parameters, and operations such as further described herein.

In some embodiments, appliances 100, 200 form a washer-dryer appliance pair. For example, appliances 100, 200 may form a washing machine appliance positioned adjacent to a dryer appliance. Accordingly, appliances 100, 200 may be positioned in relatively short range (e.g., within up to approximately 3 meters or up to 10 meters of one another).

In various embodiments, appliances 100, 200 may generally form an interconnected pair of appliances positioned in relatively short range of one another such as described herein, such as positioned within the same household or commercial facility as one another. Appliances 100, 200 may be configured as generally understood in the art as any household or commercial laundry appliance such as generally provided herein. For instance, the laundry appliance may be configured as, but not limited to, front opening or top opening, with or without agitator, in top-bottom configuration, or other configurations of washer and dryer appliance.

For instance, appliance 100 may form a laundry washing appliance including a wash chamber 112 at which clothing articles are positioned for washing during a wash cycle, such as generally understood in the art. Appliance 200 may form a laundry dryer appliance including a drying chamber 212 at which clothing articles from the washer appliance are positioned at the dryer appliance for drying during a drying cycle, such as generally understood in the art. It should be appreciated that a user may generally utilize the dryer appliance by inserting into the drying chamber 212 a laundry load of washed clothes removed from the washing chamber 112 at the washer appliance. For instance, insertion of a laundry load for drying at the dryer appliance may generally follow completion of a wash cycle at the washer appliance.

Appliances 100, 200 generally include respective sensors 110, 210 configured to determine a laundry load size, a washer load type or base cycle type, a dry load size at the washer appliance and dryer appliance, a wet load size at the washer appliance and the dryer appliance, or combinations thereof. For instance, sensors 110, 210 may form load sensors or pressure sensors configured to determine weight of laundry articles at the chamber 112, 212. For instance, sensors 110, 210 may form delta weight or delta pressure sensors configured to determine a difference between an empty chamber weight and a laundry-loaded weight, or between a dry laundry load weight and a wet laundry load weight, or between a dry laundry load weight and an empty chamber weight, or between a wet laundry load weight and an empty chamber weight. However, sensors 110, 210 may include any appropriate configuration for determining weight of laundry load at the respective chamber 112, 212.

Appliances 100, 200 each include a respective controller 120, 220 configured to regulate, allow, inhibit, articulate, or otherwise operate appliances 100, 200. In various embodiments, sensors 110, 210 are operably coupled to respective controllers 120, 220 at respective appliances 100, 200. Controller 120, 220 may be positioned in a variety of locations throughout appliance 100, 200 (e.g., a control panel area, at a door, etc.). In some embodiments, input/output ("I/O") signals are routed between controller 120, 220 and various operational components of appliance 100, 200 along wiring harnesses that may be routed. Controller 120, 220 may include a user interface panel through which a user may select various operational features and operating modes and monitor progress of the appliance 100, 200. The user interface may represent a general purpose I/O ("GPIO") device or functional block. Additionally, the user interface may include input components, such as one or more of a variety of electrical, mechanical, or electro-mechanical input devices including rotary dials, push buttons, and touch pads. The user interface may also include a display component, such as a digital or analog display device designed to provide operational feedback to a user. The user interface may be in communication with the controller 120, 220 via one or more signal lines or shared communication busses.

Controllers 120, 220 include one or more processing devices 122, 222 and memory devices 124, 224. As used herein, the terms "processing device," "computing device," "controller," or the like may generally refer to any suitable processing device, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. In addition, these "controllers" are not necessarily restricted to a single element but may include any suitable number, type, and configuration of processing devices integrated in any suitable manner to facilitate appliance operation. Alternatively, controller 120, 220 may be constructed without using a microprocessor, e.g., using a combination of discrete analog and/or digital logic circuitry (such as switches, amplifiers, integrators, comparators, flip-flops, AND/OR gates, and the like) to perform control functionality instead of relying upon software.

Memory devices 124, 224 may include non-transitory computer-readable storage mediums, such as RAM, ROM, EEPROM, EPROM, flash memory devices, magnetic disks, or other suitable memory devices (including combinations thereof). These memory devices may be a separate component from the processing device 122, 222 or may be included onboard within the processor. In addition, these memory devices 124, 224 can store information and/or data accessible by the one or more processors 122, 222, including instructions 126, 226 that can be executed by the one or more processors, such as one or more steps of method 1000. It should be appreciated that instructions 126, 226 can be software written in any suitable programming language or can be implemented in hardware. Additionally, or alternatively, instructions 126, 226 can be executed logically and/or virtually using separate threads on one or more processors 122, 222. Executed instructions 126, 226 cause the system 90, the appliances 100, 200, or server 150 to perform operations, such as one or more steps of method 1000 provided further herein.

For example, controller 120, 220 may be operable to execute programming instructions 126, 226 or micro-control code associated with an operating cycle or operating mode of appliance 100, 200, or a controls update. In this regard, the instructions 126, 226 may be software or any set of instructions that when executed by the processing device, cause the processing device to perform operations, such as running one or more software applications, displaying a user interface, receiving user input signals, processing user input signals, or permitting or disabling operation of the appliance 100, 200.

Moreover, it should be noted that controller 120, 220 as disclosed herein is additionally, or alternatively, configured to transmit signals, store, execute, or otherwise operate or perform any one or more methods, method steps, or portions of methods as disclosed herein. For example, in some embodiments, methods disclosed herein may be embodied in programming instructions stored in the memory device at one or more of controller 120, 220 or server 150. The memory devices may also store data that can be retrieved, manipulated, created, or stored by the one or more processors or portions of controller 120, 220.

Referring still to FIG. 2, one or more of the appliances includes the controller communicatively coupled to an internet communications device (e.g., device 128, 228) and a short range radio communications device (e.g., device 130, 230). In some embodiments, the short range communications device is coupled in parallel to the controller relative to the internet communications device. For instance, the short range communications device is coupled to the controller such as to allow for communication between the controller and the short range communications device without requiring operation or operability of the internet communications device at the appliance.

In various embodiments, such as schematically depicted in FIG. 2, the appliance includes a communications bus 134 between the controller and short range radio communications device (e.g., between controller 120 and device 128, between controller 220 and device 228), such as a direct communications bus. In still various embodiments, the appliance includes a communications bus 136 between the internet communications device and the short range radio communications device (e.g., between device 128 and 130, between device 228 and 230), such as a direct communications bus. In some embodiments, the internet communications device may be configured to direct communicative coupling with the controller (e.g., device 128 to controller 120, device 228 to controller 220).

Figure 3:
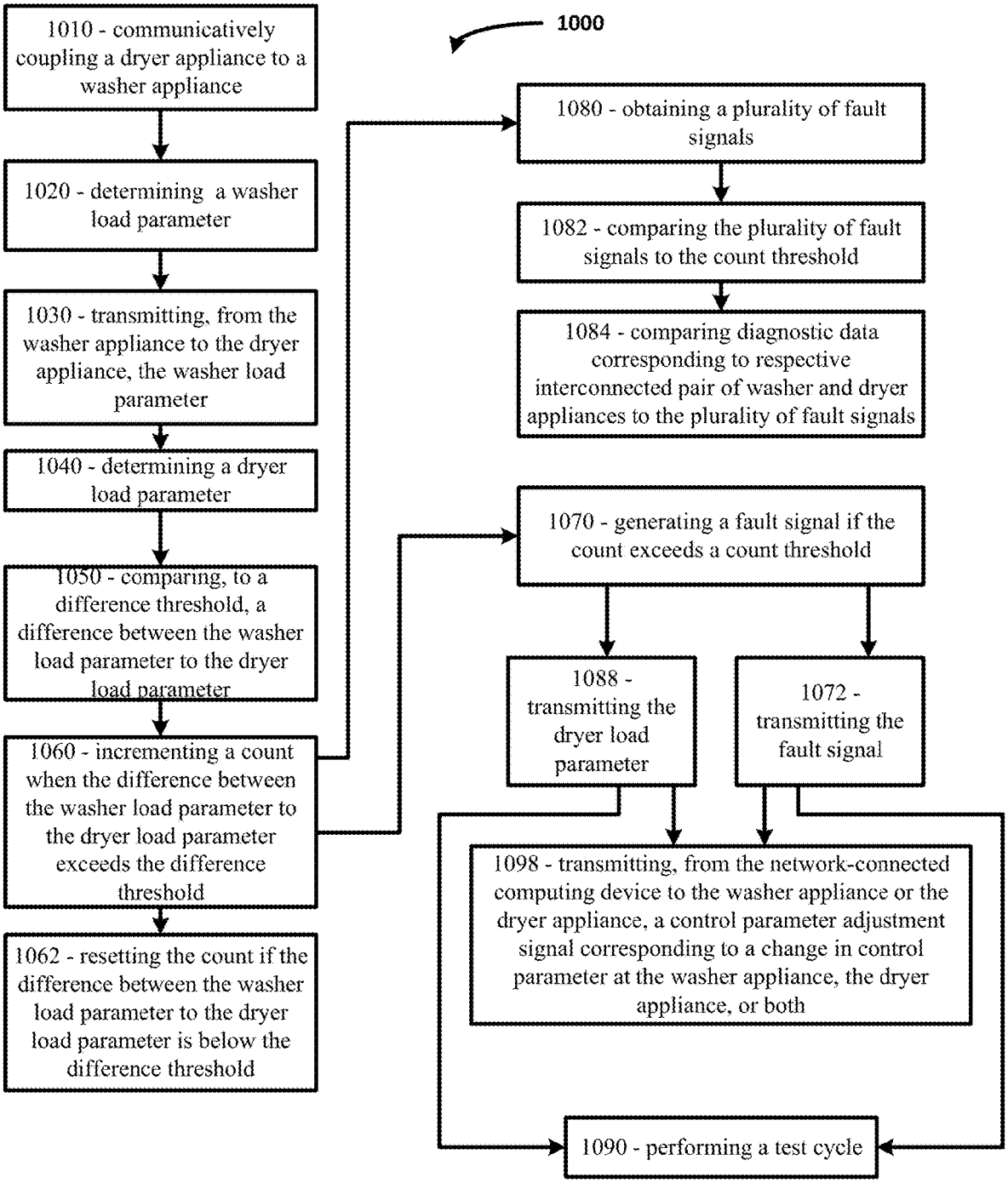
FIG. 3 provides a flowchart outlining steps of a method for determining an operational state of an appliance in accordance with aspects of the present disclosure.

Referring now to FIG. 3, a flowchart outlining exemplary steps of the method 1000 are provided. It should be appreciated that steps provided herein may be rearranged, iterated, performed in series or parallel, or omitted. As provided above, embodiments of the method 1000, or portions thereof, may form steps or instructions executable via a controller (e.g., controller 120, 220), that, when executed, causes an interconnected system of appliances (e.g., appliances 100, 200), to perform operations.

Method 1000 may include at 1010 communicatively coupling the dryer appliance (e.g., second appliance 200) to the washer appliance (e.g., first appliance 100). Method 1000 at 1010 may include communicatively coupling the washer and dryer appliances together to form an interconnected pair of washer and dryer appliance via a first short-range communications device (e.g., device 130) to a second short-range communications device (e.g., device 230).

Method 1000 includes at 1020 determining (e.g., via sensor 110 at first appliance 100), a washer load parameter. The washer load parameter may include washer link data, such as one or more of a washer load type or base cycle type, a first dry load size, a first wet load size, or combinations thereof. For instance, the washer load type may correspond to normal laundry articles, delicate laundry articles, bedding, heavy duty articles, or other appropriate types of laundry articles and wash modes at the washer appliance. The first dry load size may be determined by one or more sensors (e.g., sensor 110) configured to determine a weight of a laundry load at a wash chamber (e.g., wash chamber 112) prior to wetting clothes in a wash cycle. The first wet load size may be determined by one or more sensors configured to determine weight of the laundry load at the wash chamber after performing the wash cycle.

Method 1000 includes at 1030 transmitting, from the washer appliance to the dryer appliance, the washer load parameter. Method 1000 may include transmitting the washer load parameter via the communicatively coupling of the interconnected pair of washer and dryer appliance, such as at method 1000 at 1010.

Method 1000 includes at 1040 determining (e.g., via sensor 210 at second appliance 200), a dryer load parameter. The dryer load parameter may include one or more of a dryer load type, a second wet load size, a second dry load size, or combinations thereof. For instance, the second wet load size may be determined by one or more sensors (e.g., sensor 210) configured to determine a weight of a laundry load at a dryer chamber (e.g., dryer chamber 212) prior to drying clothes in a drying cycle. The second dry load size may be determined by one or more sensors configured to determine weight of the laundry load at the dryer chamber after performing the drying cycle.

Method 1000 includes at 1050 comparing, to a difference threshold, a difference between the washer load parameter to the dryer load parameter. The difference threshold includes a delta, error, or range of difference between the washer load parameter and a corresponding dryer load parameter. In some embodiments, comparing the difference between the washer load parameter and the dryer load parameter includes comparing a difference between the first wet load size (e.g., determined at the washer appliance 100) and the second wet load size (e.g., determined at the dryer appliance 200). In still some embodiments, comparing the difference between the washer load parameter and the dryer load parameter includes comparing a difference between the first dry load size (e.g., determined at the washer appliance 100) and the second dry load size (e.g., determined at the dryer appliance 200). Embodiments of the difference threshold may include a difference between the washer load parameter and the dryer load parameter of 2% or greater, or of 5% or greater, or of 10% or greater, or of 15% or greater, or up to 25%, or up to 33%.

Method 1000 includes at 1060 incrementing a count when the difference between the washer load parameter to the dryer load parameter exceeds the difference threshold, such as the difference determined at 1050. For instance, method 1000 at 1060 may count each instance at which the difference determined at 1050 exceeds the difference threshold. In various embodiments, method 1000 includes at 1062 resetting the count if the difference between the washer load parameter to the dryer load parameter is below the difference threshold.

In an exemplary embodiment of operation, the count is reset to zero when the difference between the washer load parameter and the dryer load parameter is below the difference threshold. For instance, exceeding the difference threshold at 1050 may correspond to a portion of the laundry load being removed after the wash cycle at the washer appliance and prior to performing the drying cycle at the dryer appliance (e.g., various laundry articles included in the wash cycle being excluded from the drying cycle, such as air dried). A succeeding wash cycle may include all, or substantially all, of the laundry load being included in the drying cycle at the dryer appliance after performing the wash cycle at the wash appliance. In such an instance, the difference threshold may not be exceeded and the count can reset to zero.

Method 1000 includes at 1070 generating a fault signal if the count exceeds a count threshold. Various embodiments of method 1000 may include iterations of method 1000 at steps 1020, 1030, 1040, 1050, and 1060. For instance, iterative performance of the method 1000 may increase the count following successive exceedance of the difference threshold. The count threshold includes a limit at or above which the fault signal is generated. The count threshold may include any desired quantity at or over which corresponds to a discrepancy between the calculation or sensor (e.g., sensor 110) at the washer appliance and the calculation or sensor (e.g., sensor 210) at the dryer appliance relative to load size detection between the washer and dryer appliances.

In some embodiments, method 1000 includes at 1072 transmitting the fault signal. Transmitting the fault signal may include transmitting sensor calibration information, component configuration (e.g., serial numbers, lot numbers, manufacturing identifiers, supplier identifiers, bar codes, SKU numbers, etc.) configuration parameter (e.g., constants, windages, calculations, etc. associated to a calculation or component), cycle or other diagnostic data corresponding to the dryer cycle, the washer cycle, or both. Transmitting the fault signal may further include transmitting the washer parameter, the dryer parameter, or both, corresponding to the count, or plurality thereof (e.g., the parameters corresponding to performance of iterations of method 1000 such as described herein). In various embodiments, transmitting the fault signal includes transmitting the fault signal from the dryer appliance (e.g., second appliance 200) to the washer appliance (e.g., first appliance 100), such as via communicative coupling of the short-range communications devices (e.g., devices 130, 230), such as provided at step 1010. In still various embodiments, transmitting the fault signal includes transmitting the fault signal from the washer or dryer appliance to a network-connected computing device (e.g., server 150, such as depicted schematically via lines 140, 142 in FIG. 2), such as via the internet communications devices 228 at the dryer appliance, or internet communications device 128 at the washer appliance.

Embodiments of the method 1000, such as described herein, may provide a method for determining an operational state at a laundry appliance, such as one or both of the washer appliance or the dryer appliance. Determining the operational state may include determining an operation state of one or more sensors (e.g., sensor 110, 210), controllers (e.g., controller 120, 220), or instructions therewith (e.g., instructions 126, 226) for calculating or determining load size at the washer appliance, the dryer appliance, or both.

Embodiments of the method 1000 may facilitate detection, determination, or resolution of issues that may be related to one or more sensors, controllers, or instructions at one or more of the washer appliance or dryer appliance. For instance, embodiments of the method 1000 may facilitate utilizing the washer appliance to determine an operational state of the dryer appliance, or components thereof.

In some embodiments, method 1000 includes at 1080 obtaining (e.g., at a network-connected computing device, such as server 150) a plurality of fault signals, such as generated via step 1070 and transmitted via step 1072. Obtaining the plurality of fault signals may include obtaining the plurality of fault signals from a plurality of interconnected pairs of washer and dryer appliances, such as a plurality of pair of appliances 100, 200 interconnected to one another. Method 1000 may include at 1082 comparing the plurality of fault signals to the count threshold, and at 1084 comparing diagnostic data corresponding to respective interconnected pair of washer and dryer appliances to the plurality of fault signals, such as to determine a correlation between diagnostic data and the fault signal. For instance, method 1000 at 1084 may include diagnostic data such as described in regard to step 1072.

In various embodiments, method 1000 may include at 1088 transmitting (e.g., from the dryer appliance to the washer appliance), the dryer load parameter.

In still some embodiments, method 1000 includes at 1090 performing a test cycle. In various embodiments, method 1000 includes at 1092 obtaining, via the washer appliance (e.g., first appliance 100), a second washer load parameter after obtaining the dryer load parameter, such as provided at step 1072 or step 1088. For instance, step 1092 may include obtaining, via the washer appliance, a third wet load size after obtaining, via the dryer appliance, the second wet load size. In still another instance, step 1092 may include obtaining, via the washer appliance, a third dry load size after obtaining, via the dryer appliance, the second dry load size.

Method 1000 may include at 1094 determining a difference between the second washer load parameter and the dryer load parameter, such as described in regard to a first washer load parameter determined at step 1020. For instance, step 1094 may include determining a difference between the third wet load size and the second wet load size. In still another instance, step 1094 may include determining a difference between the third dry load size and the second dry load size.

Method 1000 may include at 1096 comparing the difference between the second washer load parameter and the dryer load parameter to a second difference threshold. Embodiments of the second washer load parameter may correspond to the washer load parameter described in regard to step 1020. The second difference threshold may include a wet load second difference threshold, a dry load second difference threshold, or both. For instance, step 1096 may include comparing the difference between the third wet load size and the second wet load size to a wet load second difference threshold. In another instance, step 1096 may include comparing the difference between the third dry load size and the second dry load size to a dry load difference threshold. As provided herein, embodiments of the second difference threshold may include a difference of 2% or greater, or of 5% or greater, or of 10% or greater, or of 15% or greater, or up to 25%, or up to 33%.

In some various embodiments, method 1000 may include at 1098 transmitting, from the network-connected computing device to the washer appliance or the dryer appliance, a control parameter adjustment signal corresponding to a change in control parameter at the washer appliance, the dryer appliance, or both. The control parameter adjustment may correspond to a change for determining the washer parameter, the dryer parameter, or both. For instance, the control parameter adjustment may include an adjustment to a constant, windage, equation, function, table, or variable for determining the washer parameter, the dryer parameter, or both. The control parameter adjustment may include an adjustment to operation of a component at the washer appliance, the dryer appliance, or both.

Embodiments of the method 1000 may facilitate adjustment of calculations or parameters for a drying cycle, such as may correct or address discrepancies between sensors or methods for load size determination at the washer appliance and the dryer appliance. Embodiments of the method 1000 may avoid replacement of components, technician visits, or performance losses at the appliance(s). Embodiments of the method 1000 may additionally, or alternatively, determine parameters or cycles that may correspond or contribute to discrepancy between determination of load size at the washer appliance and the dryer appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A system for appliance communication for determining an operational state at a laundry appliance, the system comprising:

a washer appliance comprising one or more washer appliance sensors configured to determine a washer load parameter, the washer appliance comprising a first controller comprising a first communications device;

a dryer appliance comprising one or more dryer appliance sensors configured to determine a dryer load parameter, the dryer appliance comprising a second controller comprising a second communications device configured to communicatively couple to the first communications device to form an interconnected pair of washer and dryer appliances;

wherein one or both of the first and second controllers is configured to execute instructions that cause the washer appliance and the dryer appliance to perform operations, the operations comprising:

transmitting, via the first communications device to the second communications device, the washer load parameter;

determining, via the one or more dryer appliance sensors, the dryer load parameter;

comparing a difference between the washer load parameter to the dryer load parameter to a difference threshold;

incrementing a count when the difference between the washer load parameter to the dryer load parameter exceeds the difference threshold; and generating a fault signal if the count exceeds a count threshold.

2. The system of claim 1, the operations comprising:

resetting the count if the difference between the washer load parameter to the dryer load parameter is below the difference threshold.

3. The system of claim 1, wherein the washer load parameter comprises one or more of a washer load type, a first dry load size, a first wet load size, or combinations thereof, and wherein the dryer load parameter comprises one or more of a dryer load type, a second wet load size, a second dry load size, or combinations thereof.

4. The system of claim 1, wherein the fault signal is indicative of differing load size detection at the washer appliance and the dryer appliance.

5. A computer-implemented method for determining an operational state at a laundry appliance, the method comprising:

determining, via one or more sensors at a washer appliance, a washer load parameter, the washer load parameter comprising one or more of a washer load type, a first dry load size, a first wet load size, or combinations thereof;

transmitting, from the washer appliance to a dryer appliance, the washer load parameter;

determining, via one or more sensors at the dryer appliance, a dryer load parameter, the dryer load parameter comprising one or more of a dryer load type, a second wet load size, a second dry load size, or combinations thereof;

comparing a difference between the washer load parameter to the dryer load parameter to a difference threshold;

incrementing a count when the difference between the washer load parameter to the dryer load parameter exceeds the difference threshold; and generating a fault signal if the count exceeds a count threshold.

6. The method of claim 5, the method comprising:

resetting the count if the difference between the washer load parameter to the dryer load parameter is below the threshold.

7. The method of claim 5, wherein the fault signal is indicative of differing load size detection at the washer appliance and the dryer appliance.

8. The method of claim 5, wherein comparing the difference between the washer load parameter to the dryer load parameter to the difference threshold comprises comparing the first dry load size to the second dry load size.

9. The method of claim 5, wherein comparing the difference between the washer load parameter to the dryer load parameter to the difference threshold comprises comparing the first wet load size to the second wet load size.

10. The method of claim 5, the method comprising:

transmitting, from the dryer appliance to the washer appliance via a second communications device of the dryer appliance to a first communications device of the washer appliance, the dryer load parameter, wherein the first and second communications devices each comprise a short-range communications device.

11. The method of claim 10, the method comprising:

obtaining, via the washer appliance, a third wet load size after obtaining, via the dryer appliance, the second wet load size;

determining a difference between the third wet load size and the second wet load size; and comparing the difference between the third wet load size and the second wet load size to a wet load second difference threshold.

12. The method of claim 10, the method comprising:

obtaining, via the washer appliance, a third dry load size after obtaining, via the dryer appliance, the second dry load size;

determining a difference between the third dry load size and the second dry load size; and comparing the difference between the third dry load size and the second dry load size to a dry load difference threshold.

13. The method of claim 5, the method comprising:

transmitting, to a network-connected computing device, the fault signal if the count exceeds the count threshold.

14. The method of claim 13, the method comprising:

obtaining, at the network-connected computing device, a plurality of fault signals from a plurality of interconnected pair of washer and dryer appliances;

comparing the plurality of fault signals to the count threshold;

comparing diagnostic data corresponding to respective interconnected pair of washer and dryer appliances to the plurality of fault signals to determine a correlation between diagnostic data and the fault signal.

15. The method of claim 13, the method comprising:

transmitting, from the network-connected computing device to the washer appliance or the dryer appliance, a control parameter adjustment signal corresponding to a change in control parameter at the washer appliance, the dryer appliance.

16. A system for appliance communication, the system comprising:

a washer appliance comprising one or more washer appliance sensors configured to determine a washer load parameter, the washer appliance comprising a first controller comprising a first communications device;

a dryer appliance comprising one or more dryer appliance sensors configured to determine a dryer load parameter, the dryer appliance comprising a second controller comprising a second communications device configured to communicatively couple to the first communications device to form an interconnected pair of washer and dryer appliances;

wherein one or both of the first and second controllers is configured to execute instructions that cause the washer appliance and the dryer appliance to perform operations, the operations comprising steps of the computer-implemented method of claim 5.

17. The system of claim 16, wherein the first and second communications devices each comprise a short-range communications device.

18. The system of claim 17, wherein one or both of the first and second communications devices comprise an internet communications device, the operations comprising:

transmitting, via the internet communications device to a network-connected computing device, the fault signal if the count exceeds the count threshold.

19. The system of claim 18, the operations comprising:

obtaining, at the network-connected computing device, a plurality of fault signals from a plurality of interconnected pairs of washer and dryer appliances;

comparing the plurality of fault signals to the count threshold;

comparing diagnostic data corresponding to respective interconnected pair of washer and dryer appliances to the plurality of fault signals to determine a correlation between diagnostic data and the fault signal.

20. The system of claim 16, the operations comprising:

transmitting, from the dryer appliance to the washer appliance, the dryer load parameter; and performing a test cycle, the test cycle comprising:

obtaining, via the washer appliance, a second washer load parameter after obtaining, via the dryer appliance, the dryer load parameter;

determining a difference between the second washer load parameter and the dryer load parameter; and comparing the difference between the second washer load parameter and the dryer load parameter to a second difference threshold.

* * * * *